US006645011B2

(12) United States Patent
Schneider et al.

(10) Patent No.: US 6,645,011 B2
(45) Date of Patent: Nov. 11, 2003

(54) COAXIAL CONNECTION WITH LOCKING BY SNAP-FASTENING

(75) Inventors: Mario Schneider, Oberriet (CH); Olivier Guidet, Lyons (FR)

(73) Assignees: Radiall, Rosny sous Bois (FR); Huber + Suhner AG, Herisau (CH)

( * ) Notice: Subject to any disclaimer, the term of this patent is extended or adjusted under 35 U.S.C. 154(b) by 0 days.

(21) Appl. No.: 10/206,126

(22) Filed: Jul. 26, 2002

(65) Prior Publication Data

US 2003/0027435 A1 Feb. 6, 2003

(30) Foreign Application Priority Data

Aug. 3, 2001 (FR) ..... 01 10452

(51) Int. Cl.[7] ..... H01R 13/648
(52) U.S. Cl. ..... 439/609; 439/578
(58) Field of Search ..... 439/63, 581, 582, 439/609, 700, 578

(56) References Cited

U.S. PATENT DOCUMENTS 3,976,352 A 8/1976 Spinner ..... 439/140
4,012,105 A * 3/1977 Biddle ..... 439/675
4,106,839 A * 8/1978 Cooper ..... 439/609
4,326,768 A * 4/1982 Punako ..... 439/609
6,332,815 B1 * 12/2001 Bruce ..... 439/862

FOREIGN PATENT DOCUMENTS

CH 340537 8/1959

* cited by examiner

*Primary Examiner*—Tulsidas Patel
(74) *Attorney, Agent, or Firm*—Schweitzer Cornman Gross & Bondell LLP

(57) ABSTRACT

A coaxial connector with locking by snap-fastening, the connector comprising two complementary connector elements each comprising a tubular body forming a ground contact and containing a central contact, which central contact is male in one of the bodies and female in the other and is held in the corresponding body by means of insulation, wherein a first one of the connector elements has a retaining member suitable for exerting a radial force on the second connection element which is arranged in such a manner that said radial force generates an axial force on the second connector element tending to press it axially against a bearing surface of the first connector element, and wherein the body of one of the connector elements has a member inserted therein that forms an internal ground contact and that is suitable for coming into contact with an inner wall of the body of the other connector element while exerting relatively strong contact pressure thereagainst.

16 Claims, 5 Drawing Sheets

COAXIAL CONNECTION WITH LOCKING BY SNAP-FASTENING

The present invention relates to a coaxial connector with locking by snap-fastening.

BACKGROUND OF THE INVENTION

European patent application EP 1 094 565 describes a coaxial connector comprising a connector element and a complementary connector element. The connector element has a sleeve carrying snap-fastening tabs whose free ends present respective shoulders suitable for coming into abutment against a sloping surface of the complementary connector element in such a manner as to exert an axial force thereon. That connector is satisfactory in terms of leakage at microwave frequencies, but relatively high levels of interfering frequencies appear in that connector due to the phenomenon of intermodulation, and that is unacceptable, particularly in the field of telecommunications where microwave signals are being transmitted to an antenna or from an antenna.

OBJECTS AND SUMMARY OF THE INVENTION

There exists a need for coaxial connectors that present a high level of shielding against leakage in the microwave range, simultaneously with good characteristics concerning intermodulation, in particular for frequencies lying in the range 1 gigahertz (GHz) to 6 GHz approximately.

The invention satisfies this need by means of a coaxial connector with locking by snap-fastening, the connector comprising two complementary connector elements each comprising a tubular body forming a ground contact and containing a central contact, which central contact is male in one of the bodies and female in the other and is held in the corresponding body by means of insulation, wherein a first one of the connector elements has a retaining member suitable for exerting a radial force on the second connector element which is arranged in such a manner that said radial force generates an axial force on the second connector element tending to press it axially against a bearing surface of the first connector element, and wherein the body of one of the connector elements has a member inserted therein that forms an internal ground contact and that is suitable for coming into contact with an inner wall of the body of the other connector element while exerting relatively strong contact pressure thereagainst.

By means of the invention, the contact made between the internal ground contact forming member and the above-mentioned inside wall ensures electrical continuity between the two ground contact forming bodies while allowing relatively strong contact pressure to apply in the contact zones. Said internal ground contact forming member enables the major fraction of the current to be conveyed which, at high frequencies, flows in a skin thickness facing the central contact. This significantly reduces the interfering frequencies generated by the intermodulation phenomenon.

Furthermore, the electrical contact between the two connector elements obtained by means of the above-mentioned axial thrust serves to convey the residual currents generated by the leaks through the internal ground contact forming member. Since these residual currents are relatively weak and since the intermodulation phenomenon is essentially non-linear in nature, occurring only at high levels of current, this current gives rise only to low levels of interfering frequencies due to the intermodulation phenomenon. This contact also makes it possible to reduce significantly the level of leakage at microwave frequencies.

The connector of the invention thus presents shielding characteristics that are entirely satisfactory together with a low level of intermodulation.

Finally, the invention enables the elements of the connector to be assembled together easily, which assembly can be implemented essentially by snap-fastening.

Preferably, the second connector element has a front end that bears against the bearing surface of the first connector element.

In a preferred embodiment of the invention, the internal ground contact forming member is inserted by force in said first contact element.

Advantageously, the internal ground contact forming member has a plurality of elastically deformable tabs suitable for bearing against the above-mentioned inner wall.

Preferably, the second connector element has a generally frustoconical bearing surface against which the retaining member can come to bear so that the radial force exerted thereby generates an axial force on the second element.

Said generally frustoconical surface may be formed in an annular groove of the body of the second connector element.

In an embodiment of the invention, the retaining member is constituted by a generally frustoconical split ring that presents radial elasticity.

The axial end of the split ring presenting the smaller cross-section may have a rim that is directed radially outwards.

In another embodiment of the invention, the retaining member has elastically deformable tabs with free ends that together define an annular bead suitable for coming to bear against said generally frustoconical surface.

In which case, the retaining member also forms an external ground contact.

The front end of the second connector element may come directly into contact with a wall made on the body of the first connector element.

In a variant, said first connector element includes an axially-compressible gasket made in particular out of an elastomer filled with a conductive metal, the front end of the second connector element coming to bear against said gasket.

The gasket may be housed in an annular groove of the internal ground contact forming member.

Because of the compressibility of the gasket, it is possible to make some of component parts of the connector using dimensional tolerances that are slacker.

In a variant, the connector includes a contact washer interposed between the front end of the second connector element and a wall of the first connector element, said washer being suitable for being compressed axially.

The washer may present an undulating profile, or in a variant it may be generally frustoconical in shape.

The washer may be made of an elastic metal material, for example.

BRIEF DESCRIPTION OF THE DRAWINGS

The invention will be better understood on reading the following detailed description of non-limiting embodiments, and on examining the accompanying drawings, in which.

MORE DETAILED DESCRIPTION

Figure 1:
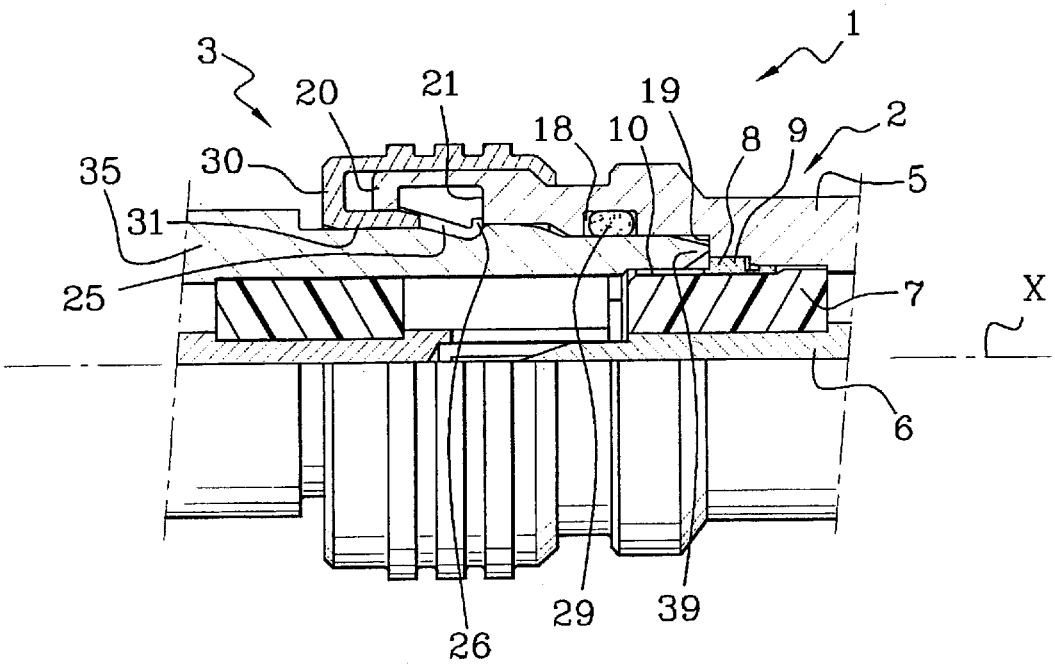
FIG. 1 is a diagrammatic and fragmentary view in partial axial section of a connector constituting a first embodiment of the invention.

FIG. 1 shows a connector 1 of the invention comprising a first connector element given overall reference 2 and arranged in the example described as a male plug, together with a second connector element given overall reference 3 and arranged as a female receptacle.

Figure 2:
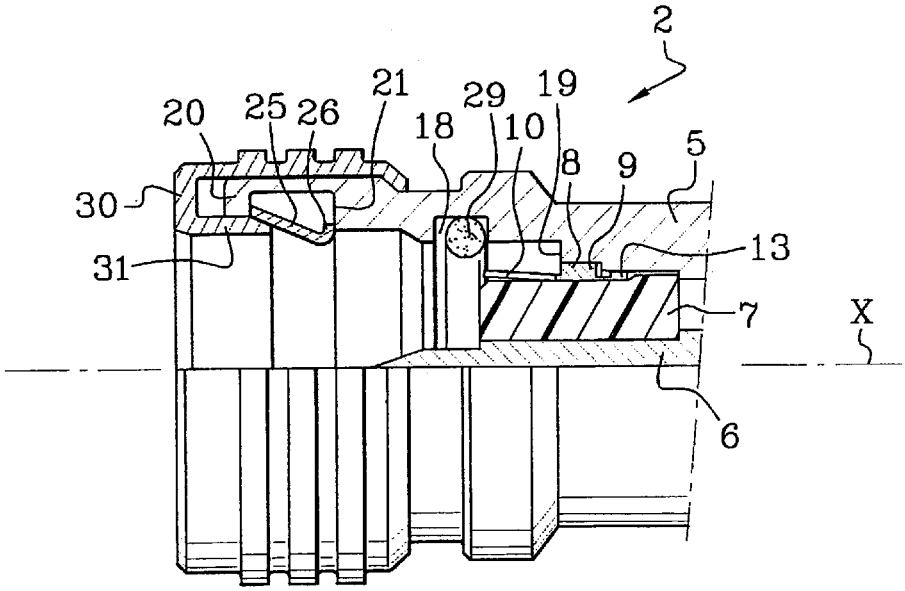
FIGS. 2 and 3 are diagrammatic fragmentary views in partial axial section respectively of each of the two connector elements of the FIG. 1 connector.

The first connector element 2 shown in isolation in FIG. 2 comprises a conductive body 5 that is circularly symmetrical about an axis X that forms a ground contact, a central contact 6, and insulation 7 in which the central contact 6 is held.

Figure 4:
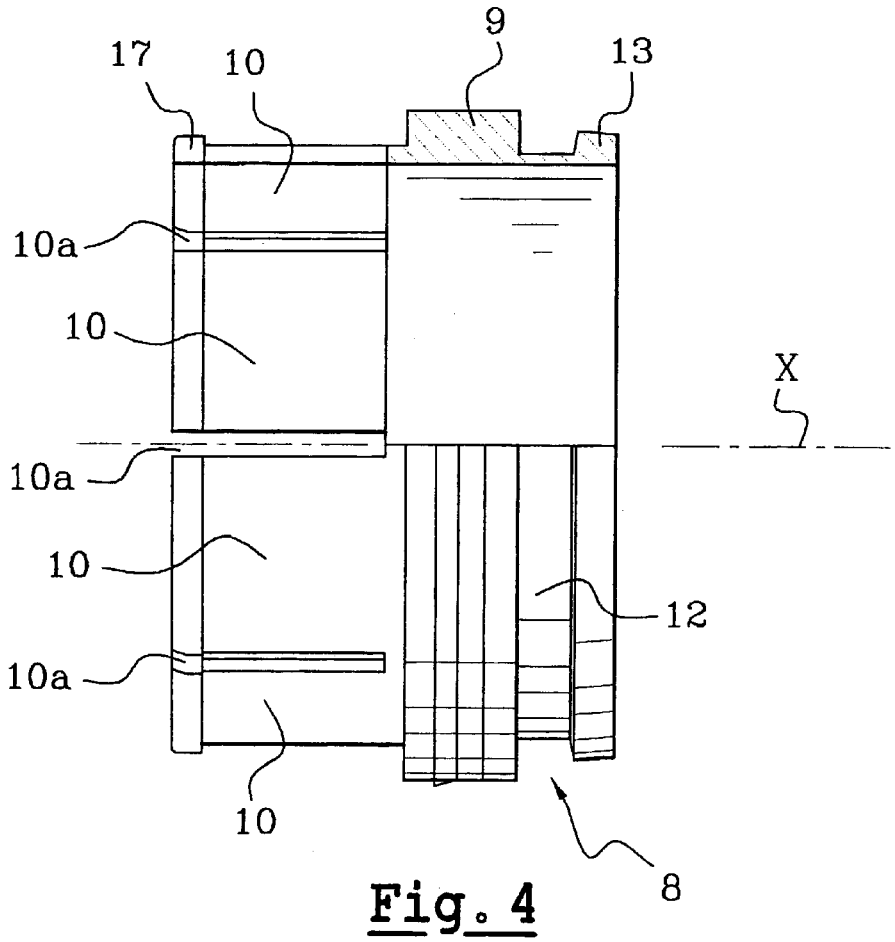
FIG. 4 is a diagrammatic view in partial axial section of an internal ground contact forming member of the FIG. 1 connector.

The insulation 7 is inserted in a member 8 forming an internal ground contact that comprises a central annular ring 9 having connected to one end thereof a plurality of elastically deformable tabs 10 and to the other end thereof an extension 12 extending rearwards and presenting at its free end an annular bead 13, as can be seen in particular in FIG. 4.

The free ends of the tabs 10 together define an annular bead 17.

The member 8 is inserted by force into the cavity in the tubular body 5, with the annular bead 13 coming to bear against the inside wall of the body 5.

The body 5 has an inner annular groove 18 in which there is received a gasket 29, and at its front end it has a rim 20 that is directed radially towards the axis X.

Figure 5:
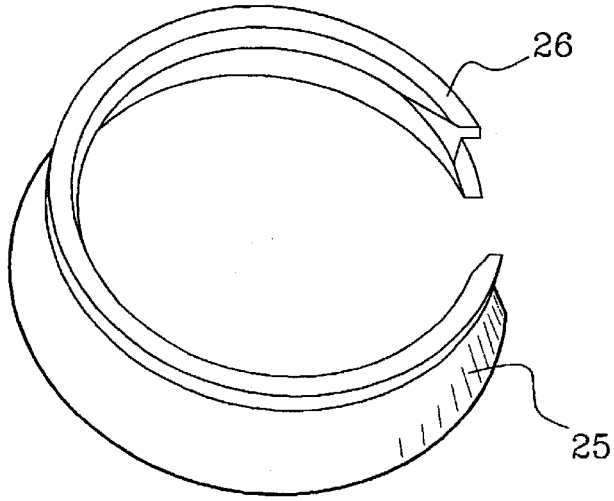
FIG. 5 is a diagrammatic perspective view of a retaining member of the FIG. 1 connector.

The first connector element 2 also has a retaining member 25 shown on its own in FIG. 5 and constituted in the example described by a ring on the axis X, said ring being split so as to present a degree of radial elasticity. The split ring 25 is generally frustoconical in shape having at its end of smaller cross-section a rim 26 that is directed radially outwards. The split ring 25 is received in the body 5 with a certain amount of clearance between an inner shoulder 21 of the body 5 and the rim 20, thus allowing the split ring 25 to be deformed radially while the two elements of the connector are being connected together.

At its front end, the body 5 receives a cap 30 having a folded-in margin 31 whose free end comes into contact with the split ring 25.

Figure 3:
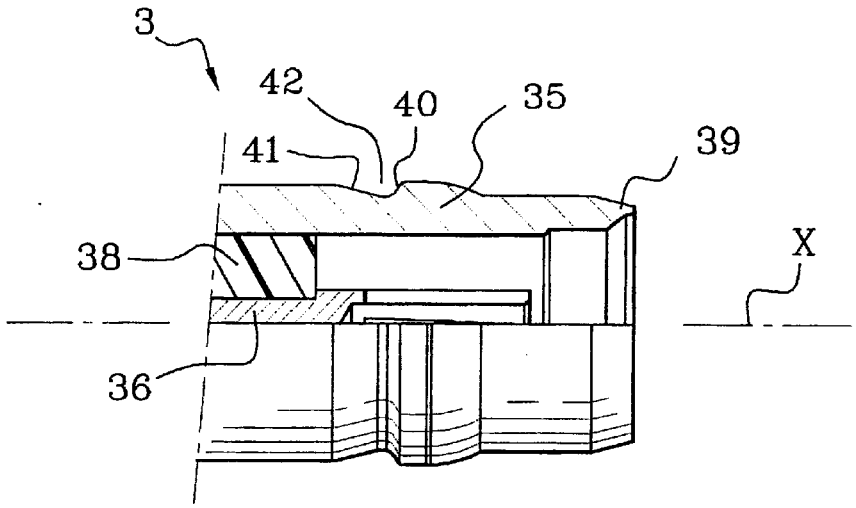

As can be seen in FIG. 3, in particular, the second connector element 3 comprises a conductive body 35 that is circularly tubular about the axis X and that forms a ground contact, a central contact 36, and insulation 38 interposed between the tubular body 35 and the central contact 36.

The body 35 presents a pointed front end 39.

On its outer wall, the body 35 has a frustoconical bearing surface 40 that converges rearwards, which surface 40 co-operates with another frustoconical surface 41 of opposite slope to form an annular groove 42.

When the two connector elements 2 and 3 are assembled together, the split ring 25 is received in part in the groove 42, the rim 26 then bearing against the frustoconical bearing surface 40 so that the radial force exerted by the split ring 25 is converted into an axial force along the axis X exerted on the connector element 3. The front end 39 of the connector element 3 is thus pressed axially into contact with an inner wall 19 constituted by a shoulder on the body 5.

The tabs 10 of the internal ground contact forming member 8 act via the annular bead 17 to exert a radial force on the inner wall of the body 35, thus producing a large amount of contact pressure.

The member 8 serves to convey the major fraction of the current which, at high frequency, flows in a skin thickness facing the central contact 6.

Thus, the interfering frequencies due to the intermodulation phenomenon are at a relatively low level.

Finally, the electrical contact between the front end 39 of the body 35 and the inner wall 19 of the body 5 serves to convey the residual current generated by leakage through the slots 10*a* that exist between the tabs 10. Since these residual currents are at low level and since the intermodulation phenomenon is essentially of a non-linear nature, appearing for high current levels only, this contact between the front end 39 and the inner wall 19 gives rise to only low levels of interfering frequencies due to the intermodulation phenomenon.

This contact serves to further improve reductions of leakage at microwave frequencies in that its own shielding effect, to a first approximation, is cumulative with the effect obtained by the line of contact between the member 8 and the bodies 5 and 35.

In the example described above, the contact between the front end 39 of the body 35 and the body 5 takes place directly.

It would not go beyond the ambit of the present invention to interpose a conductive element between the front end 39 and the body 5.

Figure 6:
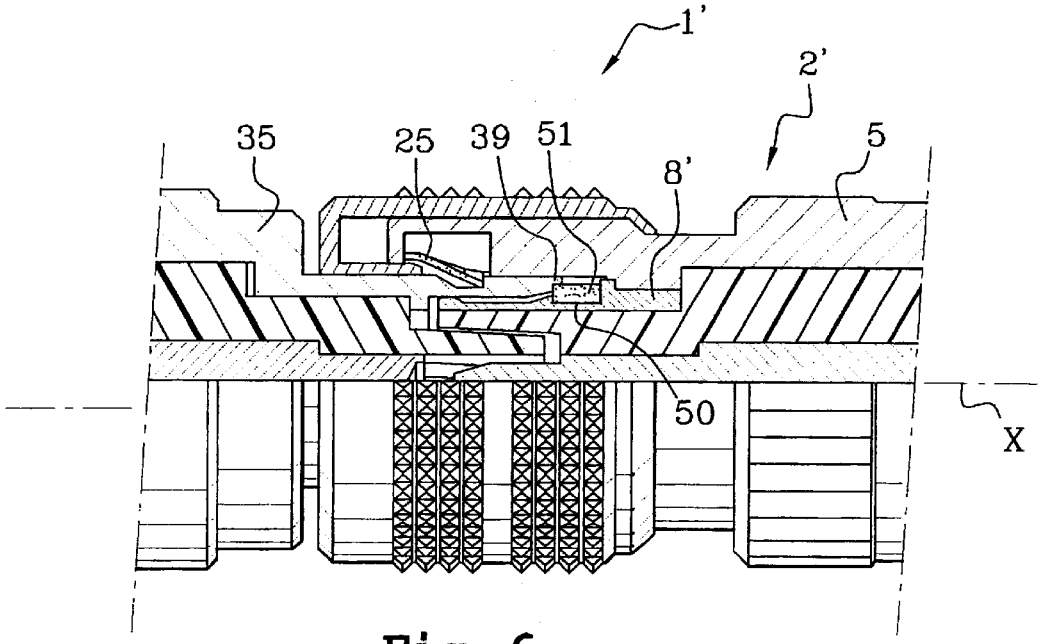
FIG. 6 is a diagrammatic and fragmentary view in partial axial section of a connector constituting a second embodiment of the invention.

FIG. 6 shows a connector 1' substantially analogous to the connector 1, but in which the first connector element 2' has an internal ground contact forming element 8 that is provided with a housing 50. This housing is annular in shape and serves to receive a gasket 51.

The front 39 of the body 35 bears against the gasket 51 which is compressed axially by the axial force exerted by the split ring 25 on the body 35.

The gasket 51 is conductive, being made of an elastomer having a conductive metal filler in the example described. Because this gasket is not situated on the main flow route for electrical current, it may even contain magnetic conductive particles without that harming performance in terms of intermodulation since the current levels that pass through this gasket remain relatively low.

Figure 7:
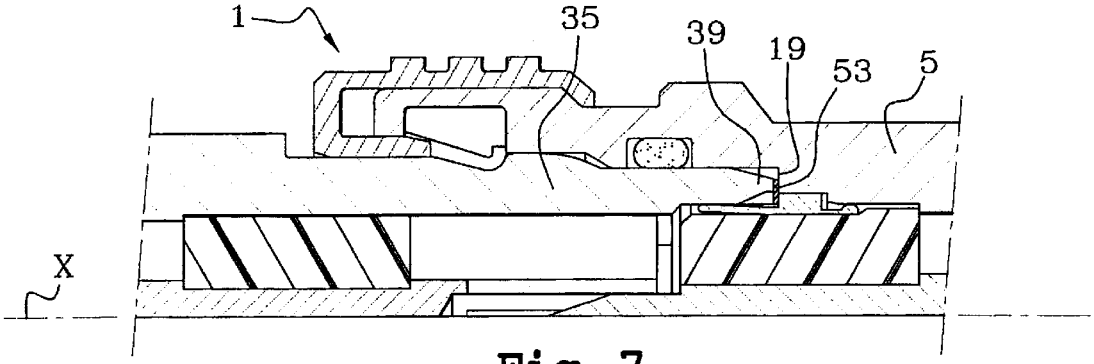
FIG. 7 is a diagrammatic and fragmentary view in axial section of a connector constituting a third embodiment of the invention.
Figure 8:
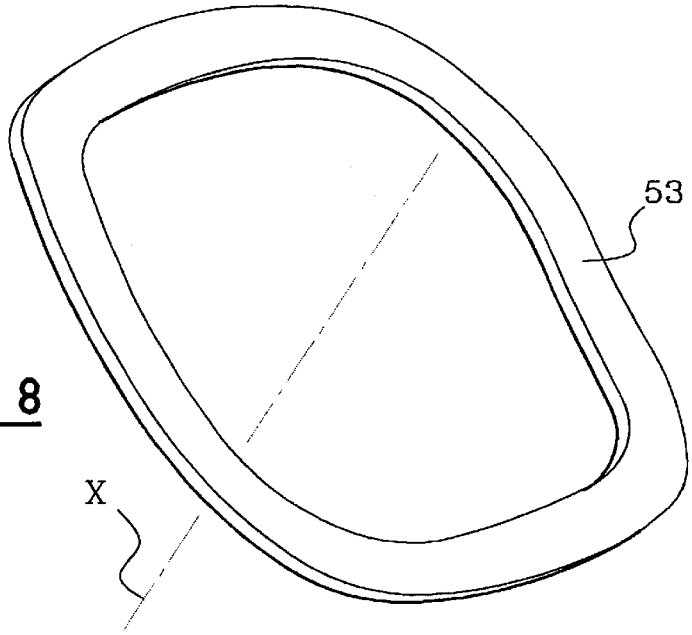
FIG. 8 is a diagrammatic perspective view of a contact washer of the FIG. 7 connector.
Figure 9:
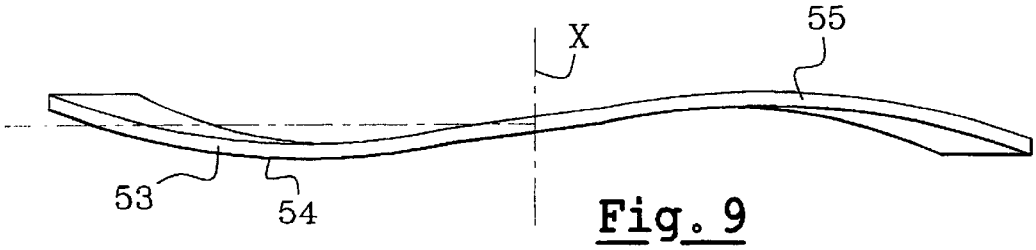
FIG. 9 is a diagrammatic profile view of the FIG. 8 contact washer.

In a variant, as shown in FIGS. 7 to 9, the connector 1 has a contact washer 53 disposed in the first connector element 2 to bear against the inner wall 19 of the body 5.

This washer 53 is generally circular in shape, as can be seen in FIG. 8 in particular, and it is made of an elastic metal material.

When seen in profile, as shown in FIG. 9, the washer 53 is undulating in shape presenting alternating furrows 54 and ridges 55 around the axis X, thereby imparting a degree of axial compressibility to the washer 53.

Once the two connector elements have been assembled together, the front end 39 of the body 35 comes to bear against the ridges 55 while the furrows 54 come into contact with the inner wall 19, thus causing the washer 53 to be compressed axially to a small extent.

It should be observed that the contact between the end 39 and the washer 53 and between the washer 53 and the wall 19 can be interrupted over certain portions of the circumference, with this contact nevertheless being sufficient to provide effective shielding.

In a variant, the contact washer can be generally frustoconical about the axis X, with one of the axial ends of the washer being in contact with the front end 39 of the body 35 while its other axial end is in contact with the inner wall 19.

The contacts it makes are then continuous over the entire circumference.

It would not go beyond the ambit of the present invention to replace the retaining element constituted by a split ring, as described above, by a retaining element of different structure.

Figure 10:
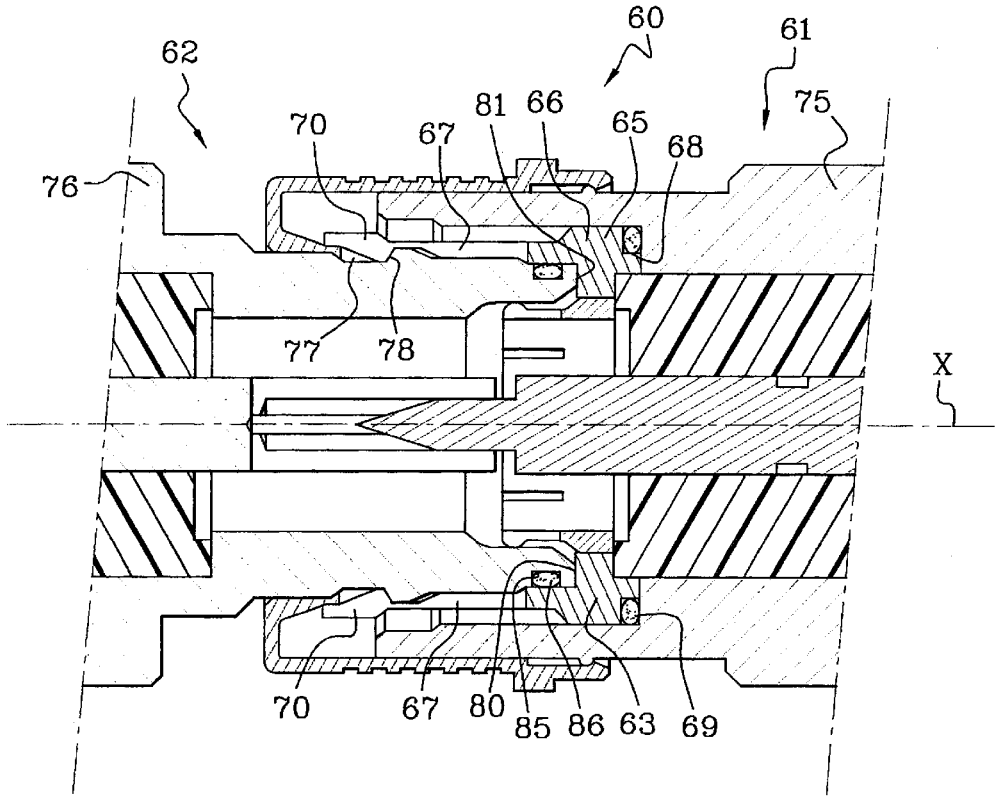
FIG. 10 is a diagrammatic and fragmentary view in axial section of a connector constituting a fourth embodiment of the invention.

FIG. 10 shows a connector 60 that comprises, like the connectors 1 and 1', a first connector element 61 and a second connector element 62.

The first connector element 61 has an internal ground contact forming member 63 that is substantially analogous to the member 8, and a retaining member 65. The retaining member comprises a ring 66 with a plurality of elastically deformable tabs 67 connected to the front thereof and with a housing 68 formed at the rear thereof in order to receive a gasket 69.

The free ends of the tabs 67 together define an annular bead 70 for performing a function that is explained below.

The ring 66 is inserted by force into the cavity of the body 75 of the first connector element 61.

The internal ground contact forming member 63 is inserted by force into the ring 66.

The body 76 of the second connector element 62 has an annular setback 77 defined at the front by a frustoconical bearing surface 78 against which the annular bead 70 can come to bear.

Thus, the radial force exerted by the tabs 67 generates an axial force enabling the front end 80 of the body 76 to be pressed against a shoulder 81 of the ring 66.

Close to its front end 80, the body 76 has an annular groove 85 receiving a gasket 86.

Naturally, the invention is not limited to the embodiments described above.

In particular, the first connector element may be arranged to be a female element and the second connector element may be arranged to be a male element.

What is claimed is:

1. A coaxial connector with locking by snap-fastening, the connector comprising two complementary connector elements each comprising a tubular body forming a ground contact and containing a central contact, which central contact is male in one of the bodies and female in the other and is held in the corresponding body by means of insulation, wherein a first one of the connector elements has a retaining member suitable for exerting a radial force on the second connection element which is arranged in such a manner that said radial force generates an axial force on the second connector element tending to press it axially against a bearing surface of the first connector element, and wherein the body of one of the connector elements has a member inserted therein that forms an internal ground contact and that is suitable for coming into contact with an inner wall of the body of the other connector element while exerting relatively strong contact pressure thereagainst.

2. A connector according to claim 1, wherein the second connector element has a front end that bears against the bearing surface of the first connector element.

3. A connector according to claim 1, wherein the internal ground contact forming member is inserted by force in said first contact element.

4. A connector according to claim 1, wherein the internal ground contact forming member has a plurality of elastically deformable tabs suitable for bearing against said inner wall.

5. A connector according to claim 1, wherein the second connector element has a generally frustoconical bearing surface against which the retaining member can come to bear so that the radial force exerted thereby generates an axial force on said second element.

6. A connector according to claim 5, wherein said generally frustoconical surface is formed in an annular groove of the body of the second connector element.

7. A connector according to claim 1, wherein the retaining member is constituted by a generally frustoconical split ring that presents radial elasticity.

8. A connector according to claim 7, wherein the axial end of the split ring presenting the smaller cross-section has a rim that is directed radially outwards.

9. A connector according to claim 5, wherein the retaining member has elastically deformable tabs with free ends that together define an annular bead suitable for coming to bear against said generally frustoconical surface.

10. A connector according to claim 1, wherein the front end of the second connector element comes directly into contact with a wall made on the body of the first connector element.

11. A connector according to claim 1, wherein said first connector element includes an axially-compressible gasket made in particular out of an elastomer filled with a conductive metal, the front end of the second connector element coming to bear against said gasket.

12. A connector according to claim 11, wherein the gasket is housed in an annular groove of the internal ground contact forming member.

13. A connector according to claim 1, including a contact washer interposed between the front end of the second connector element and a wall of the first connector element, said washer being suitable for being compressed axially.

14. A connector according to claim 13, wherein said contact washer presents an undulating profile.

15. A connector according to claim 13, wherein said contact washer is generally frustoconical in shape.

16. A connector according to claim 13, wherein said contact washer is made of an elastic metal material.

* * * * *